United States Patent [19]

Davis et al.

[11] 3,985,308

[45] Oct. 12, 1976

[54] CLEARANCE SYSTEM FOR CRUSHERS

[75] Inventors: D. Carter Davis, Menomonee; Ulhas S. Sawant, Sussex, both of Wis.

[73] Assignee: Rexnord Inc., Milwaukee, Wis.

[22] Filed: May 27, 1975

[21] Appl. No.: 580,924

[52] U.S. Cl. ..... 241/290; 92/129; 92/161; 241/207

[51] Int. Cl.[2] ..... B02C 2/04

[58] Field of Search ..... 241/207, 216, 286, 290; 92/129, 161

[56] References Cited

UNITED STATES PATENTS

| | | | |
|---|---|---|---|
| 3,009,660 | 11/1961 | Symons et al. | 241/290 |
| 3,140,835 | 7/1964 | Balmer et al. | 241/286 |
| 3,273,810 | 9/1966 | Gasparac et al. | 241/290 |
| 3,797,760 | 3/1974 | Davis et al. | 241/207 UX |
| 3,837,585 | 9/1974 | Decker et al. | 241/215 X |

*Primary Examiner*—Granville Y. Custer, Jr.
*Assistant Examiner*—Howard N. Goldberg
*Attorney, Agent, or Firm*—Kinzer, Plyer, Dorn & McEachran

[57] ABSTRACT

This is concerned with a crusher clearing system using a plurality of hydraulic jacks disposed with relation to the adjustment ring and main frame of the crusher such that the jacks, as a unit, apply a generally vertical thrust directly between the upper main frame flange and the adjustment ring so that uncrushable material may be removed from the crushing cavity in a stalled or jammed crusher.

7 Claims, 2 Drawing Figures

104
138
114
112
118
116
140
122
120
136
142
156
102
144
132
130
134
128
126
148
154
150
135
146
152
106
108
110
100

126
156
2
2
106
100
104
124
156
126

CLEARANCE SYSTEM FOR CRUSHERS

SUMMARY OF THE INVENTION

This is concerned with a crusher clearing system using a plurality of hydraulic jacks and is more specifically concerned with a hydraulic system for clearing the crushing cavity by overcoming the spring release in a gyratory crusher so that uncrushable material may be removed from or allowed to pass through the crushing cavity in a stuck or plugged crusher.

A primary object of the invention is a crusher clearing system in which a plurality of hydraulic jacks are arranged around the crusher effective to apply a generally vertical thrust between the adjustment ring and the main frame.

Another object is a crushing clearing system in which hydraulic jacks are socketed into the crusher.

Another object is a clearing system of the above type in which the jacks are screw-threaded into a part of the crusher so that they apply a thrust directly between the crusher parts in overcoming the spring release.

Another object is a jack structure which avoids alignment problems for use in a crusher clearing system.

Another object is a jack screw-threaded into the main frame flange of a crusher.

Another object is a crusher clearing system which is arranged for a simple fluid circuit.

Other objects will appear from time to time in the ensuing specification and drawings.

DESCRIPTION OF THE PREFERRED EMBODIMENT

Figure 1:
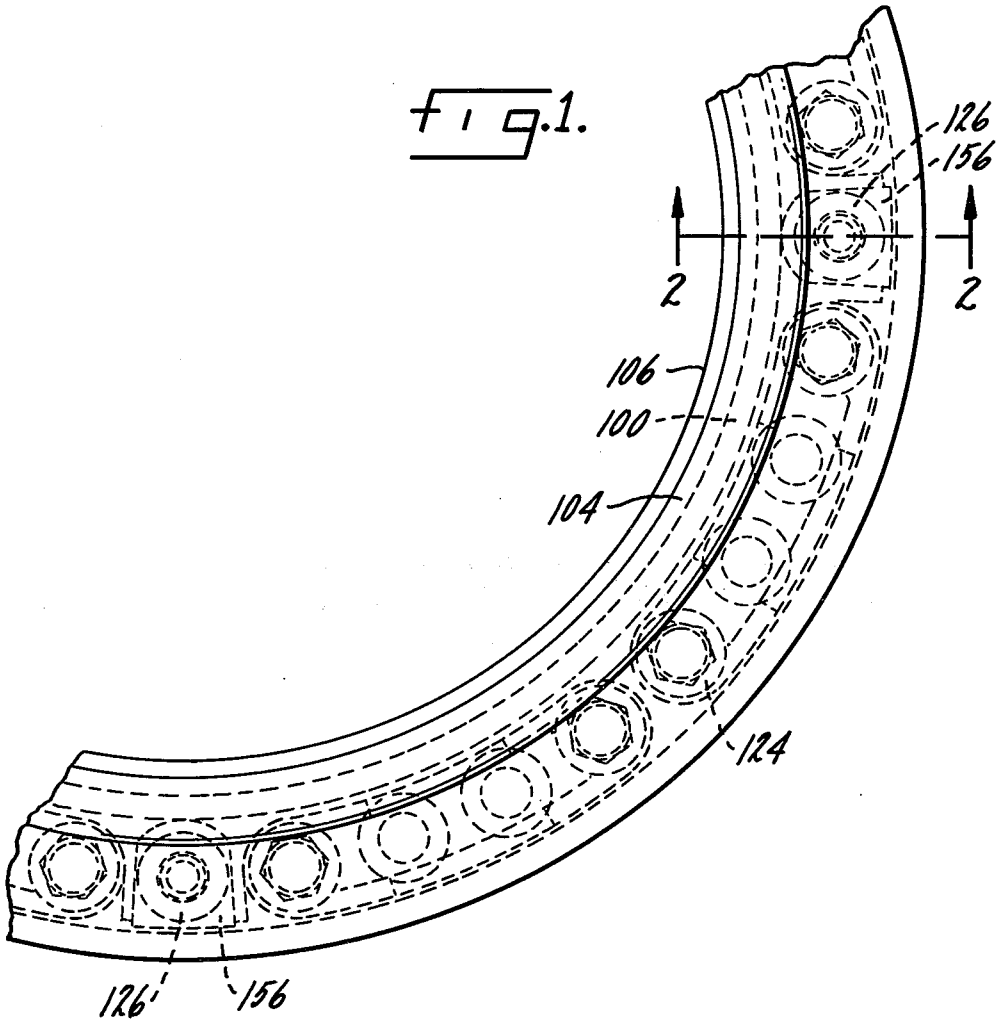
FIG. 1 is a top plan view of a part of a crusher frame with a hydraulic system for crusher clearance shown thereon.

The circumferential main frame of a crusher is indicated at 100 with an outstanding circumferential flange 102 adjacent its upper end for supporting an adjustment ring 104 having the usual screw threads 106 on the inner surface thereof for adjustably supporting a crushing bowl, not shown. The frame and adjustment ring have engaged frusto-conical surfaces 108 and 110 bounded by spaced flat surfaces 112 and 114 which in turn are bounded by contacting downward and outward frusto-conical surfaces 116 and 118 which in turn are bounded by spaced somewhat cylindrical surfaces 120 and l22. When a piece of uncrushable material, such as tramp iron, a two-by-four, a rubber casing, etc. passes through the crusher causing the adjustment ring to rise, repositioning of the adjustment ring on the upper end of the frame is controlled by inner surfaces 108 and 110 and outer surfaces 116 and 118. It will be understood that the machine may have a conventional spring release indicated generally at 124 in FIG. 1, which may include a plurality of spring bolts and springs disposed in a single row or ring around the frame of the crusher, as indicated in FIG. 1.

Figure 2:
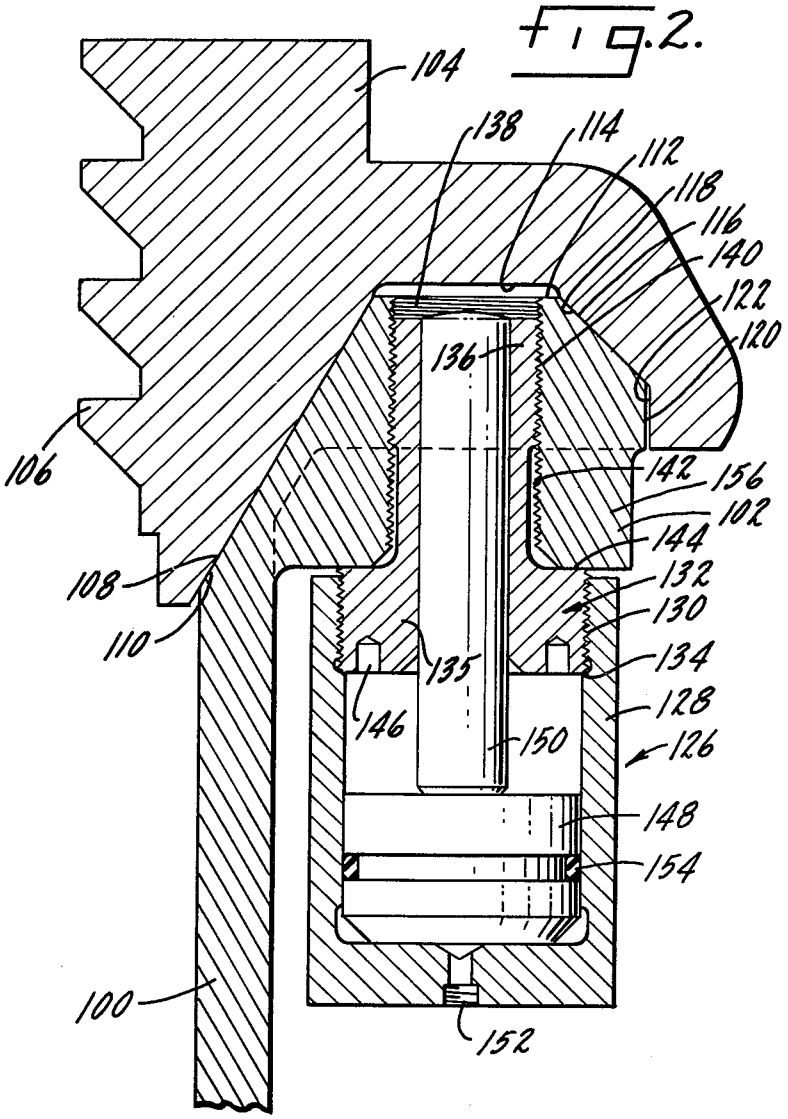
FIG. 2 is a section along line 2—2 of FIG. 1, on an enlarged scale.

To clear the crusher when the machine jams due to a large object getting stuck in the crushing cavity between the head and bowl, for example tramp iron, a big chunk of wwood, a power failure, or what-have-you, a clearance system is provided which includes a plurality of hydraulic jack elements 126. Four such jack elements are shown positioned equidistantly or about 90° apart. Each jack unit or element 126 includes a cylinder 128 which is closed on the bottom and open on top with a threaded connection 130 to a head element 132. These two parts are screwed together until abutting surfaces 134 engage which jams the threads 130. The head element has an enlarged portion 135, which screws into the cylinder with a reduced neck or extension 136 thereabove which projects into a socket or passage 138 in the main frame flange with the upper portion 140 of the head extension being threaded into the socket which may be threaded throughout its length, as shown in FIG. 2. An intermediate portion of the head extenion need not be threaded but may be relieved, as at 142, but a sufficient amount of the head extension is threaded, as at 140, to give adequate contact or engagement between the jack unit 126 and the socket in the main frame flange.

The upper surface 144 of the head enlargement abuts the bottom of the main frame flange which serves to jam the threads 140, thereby holding the jack unit firmly in place in its socket. The head element may be rotated up into the socket first and fully seated by a spanner wrench type tool or the like which fits in sockets 146 in the lower surface of the head element. Then the cylinder 128 may be turned on the enlargement of the head element until the surfaces 134 firmly abut. The cylinder itself carries a free piston 148 with a push rod 150 above it, the rod being separate from the piston or free. The bottom of the cylinder may be provided with a hydraulic connection 152 with the piston having a suitable seal 154 or the like. A hydraulic coupling and connecting tubing has not been shown leading to port or opening 152 but it should be understood that there may be any conventional fitting and tubing.

To take the load of the jacks and provide an adequate length of thread engagement, the lower surface of the main frame flange may be provided with an enlargement 156 which may be localized in the area of the jack unit, as indicated in FIG. 2.

Hydraulic fluid may be supplied to the system by a suitable hand pump, or possibly an electrically-driven pump, or any other simple or complex hydraulic circuitry and source, as desired or required by a particular installation or operation.

The use, operation and function of the invention are as follows:

In the clearance system shown and decribed, four jacks are used, about 90° apart, but there might be more or less. The jacks are screw-threaded from below into the bottom of the main frame flange. The screw threaded arrangement has the advantage that the socket or hole therefor can be drilled and tapped at the same time that all the other holes around the main frame flange are being drilled or otherwise formed. The jack itself can be simplly screwed up into the tapped socket and it does not require any sort of a mounting pedestal, supporting webs, strengthening ribs or otherwise to attach it or tie it to the side of the main frame or support it on the base flange. Socketing the jacks directly into the main frame flange from below has the advantage that the thrust will be taken directly between the adjustment ring and main frame flange so that a reduced loading is applied to or taken care of in the frame wall or in any other portion of the frame.

The particular jack shown and described has the advantage that it screw-threads together with the top of the jack abutting the bottom of the main frame flange to jam the thread. Also, the cylinder threads onto the head element and jams. All of these are put together with right-hand threads and there is no need to use a lock or key arrangement to hold the parts together since the hydraulic connections extending between the jacks around the crusher will prevent any of the parts from backing off and unthreading.

The details of the hydraulic circuit have not been shown but it should be understood that it may be a simple hand pump connected to all of the jacks.

The particular jack shown and described also has the advantage that a free piston is used with a push rod, instead of an integral or connected piston and piston rod. This has the advantage that a concentricity problem is avoided because the center of the cylinder and head, which are screwed together, do not have to be accurately aligned with the center of the piston and piston rod. Rather the piston and push rod are free to move along separate centers and are free to accept separate axes of movement. In short, all of the various centers do not have to be matched.

While a preferred form and several variations of the invention have been suggested, it should be understood that suitable additional modifications, changes, substitutions and alterations may be made without departing from the invention's fundamental theme. For example, hydraulic circuits have been shown and/or referred to. And it should be understood that fluid circuits might be a more appropriate term because many if not all aspects of the circuits could be hydraulic such as oil, pneumatic such as air or nitrogen, or a combination thereof. And the term fluid should be broadly construed.

Also, where a spring release has been referred to or described, it should be understood that in most intances either mechanical springs or air cylinders or a combination could be used.

The embodiments of the invention in which an exclusive property or privilege is claimed are defined as follows:

1. In a gyratory crusher, a generally upright main frame with an outstanding circumferential flange at the upper end thereof, an adjustment ring mounted on the main frame flange with a crushing bowl adjustably mounted therein, a crushing head mounted for gyratory movement within the main frame opposite the bowl and defining a crushing cavity therewith, a spring release yieldably holding the adjustment ring on the main frame flange but arranged to yield so that the crushing cavity may be cleared of uncrushable material, the spring release including a single row of coil springs being centered on a circle about the outside of the main frame under the main frame flange, and a clearance system for the crusher including a fluid-operated jacking system between the main frame flange and the adjustment ring so that the adjustment ring and bowl may be lifted to clear the crushing cavity, the jacking system including a plurality of fluid jacks positioned under and socketed into the main frame flange with the jacks being centered on the same circle as and interposed at intervals among the springs.

2. In a gyratory crusher, a generally upright main frame with an outstanding circumferential flange at the upper end thereof, an adjustment ring mounted on the main frame flange with a crushing bowl adjustably mounted therein, a crushing head mounted for gyratory movement within the main frame opposite the bowl and defining a crushing cavity therewith, a release yieldably holding the adjustment ring on the main frame flange but arranged to yield so that the crushing cavity may be cleared of uncrushable material, and a clearance system for the crusher including a fluid-operated jacking system between the main frame flange and the adjustment ring so that the adjustment ring and bowl may be lifted to clear the crushing cavity, the jacking system including a plurality of fluid jacks positioned under the main frame flange with the upper portion of each of the jacks screw-threaded into a socket in the main frame flange so that the thrust of the jacks is taken directly between the main frame flange and the adjustment ring, each jack including a cylinder and piston, the cylinder having an upwardly opening housing screw-threaded at its upper end to a head element, the head element having an upper portion which is of a reduced diameter and is screw-threaded into the socket in the main frame flange.

3. The structure of claim 2 further characterized by and including a lateral upwardly facing shoulder on the cylinder in engagement with the head to jam the threads between the cylinder and head, and a second lateral upwardly facing shoulder on the head element which engages the bottom of the main frame flange to jam the threads between the head element and socket in the main frame flange.

4. The structure of claim 2 further characterized in that the piston includes a free piston and separate push rod extending into the head to engage and raise the adjustment ring for clearance of uncrushable material.

5. The structure of claim 2 further characterized in that the release includes a plurality of springs disposed about the main frame.

6. In a gyratory crusher, a generally upright main frame with an outstanding circumferential flange element at the upper end thereof, an adjustment ring element mounted on the flange element with a crushing bowl adjustably mounted therein, a crushing head mounted for gyratory movement within the main frame opposite the bowl and defining a crushing cavity therewith, a release yieldably holding the adjustment ring element on the main frame flange element but arranged to yield so as to clear the crushing cavity between the head and bowl of uncrushable material, and a clearance system for the crusher including a plurality of fluid operated jacks positioned to be effective between the main frame flange element and the adjustment ring element so that the ring element will be lifted by the jacks, as a group, to clear the crushing cavity, each jack being positioned with a portion thereof screw-threaded into a socket in one of the elements so as to oppose and apply an axial thrust to the other element when the jacks, as a group, are operated, each jack including a cylinder and piston, the cylinder having a housing open at one end and screw-threaded to a head element, the head element having a portion that is of a reduced diameter and is screw-threaded into the socket in one of the elements.

7. In a gyratory crusher, a generally upright main frame with an outstanding circumferential flange element at the upper end thereof, an adjustment ring element mounted on the flange element with a crushing bowl adjustably mounted therein, a crushing head mounted for gyratory movement within the main frame opposite the bowl and defining a crushing cavity therewith, a release yieldably holding the adjustment ring element on the main frame flange element but arranged to yield so as to clear the crushing cavity between the head and bowl of uncrushable material, and a clearance system for the crusher including a plurality of fluid operated jacks positioned to be effective between the main frame flange element and the adjustment ring element so that the ring element will be lifted by the jacks, as a group, to clear the crushing cavity, each jack being positioned with a portion thereof screw-threaded into a socket in one of the elements so as to oppose and apply an axial thrust to the other element when the jacks, as a group, are operated, the piston including a free piston and separate push rod extending into the head to raise the adjustment ring for clearance of uncrushable material.

* * * * *